US007226531B2

(12) United States Patent
Lo et al.

(10) Patent No.: US 7,226,531 B2
(45) Date of Patent: Jun. 5, 2007

(54) METHOD OF MAKING AN ELECTROPLATED INTERCONNECTION WIRE OF A COMPOSITE OF METAL AND CARBON NANOTUBES

(75) Inventors: Po-Yuan Lo, Hsinchu (TW); Jung-Hua Wei, Hsinchu (TW); Bae-Horng Chen, Hsinchu (TW); Jih-Shun Chiang, Hsinchu (TW); Chian-Liang Hwang, Hsinchu (TW); Ming-Jer Kao, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/298,523

(22) Filed: Dec. 12, 2005

(65) Prior Publication Data

US 2007/0056855 A1 Mar. 15, 2007

(30) Foreign Application Priority Data

Sep. 12, 2005 (TW) ..... 94131376 A

(51) Int. Cl.
*C25D 5/02* (2006.01)
*C25D 5/56* (2006.01)

(52) U.S. Cl. ..... 205/109; 205/118; 205/125; 205/166; 205/183

(58) Field of Classification Search ..... 205/109, 205/125, 166
See application file for complete search history.

(56) References Cited

U.S. PATENT DOCUMENTS

| | | | | |
|---|---|---|---|---|
| 5,139,642 | A * | 8/1992 | Randolph et al. | 205/125 |
| 5,916,642 | A | 6/1999 | Chang | |
| 6,709,562 | B1 | 3/2004 | Andricacos et al. | |
| 6,878,259 | B2 * | 4/2005 | Taylor et al. | 205/103 |
| 2005/0189655 | A1 * | 9/2005 | Furukawa et al. | 257/762 |
| 2005/0218523 | A1 * | 10/2005 | Dubin | 257/762 |
| 2006/0043862 | A1 * | 3/2006 | Kang | 313/311 |
| 2006/0091557 | A1 * | 5/2006 | Sakamoto et al. | 257/774 |
| 2006/0094309 | A1 * | 5/2006 | Holtkamp et al. | 439/886 |

* cited by examiner

*Primary Examiner*—Roy King
*Assistant Examiner*—William T. Leader
(74) *Attorney, Agent, or Firm*—Bacon & Thomas PLLC

(57) ABSTRACT

Method of making an electroplated interconnection wire of a composite of metal and carbon nanotubes is disclosed, including electroplating a substrate having a conductive baseline on a surface thereof in an electroplating bath containing a metal ion and carbon nanotubes, so that an electroplated interconnection wire of a composite of the metal and carbon nanotubes is formed on the conductive baseline. Alternatively, a method of the present invention includes preparing a dispersion of carbon nanotubes dispersed in an organic solvent, printing a baseline with the dispersion on a surface of a substrate, evaporating the organic solvent to obtain a conductive baseline, and electroplating the surface in an electroplating bath containing a metal ion, so that an electroplated interconnection wire of a composite of the metal and carbon nanotubes is formed on the conductive baseline.

12 Claims, 1 Drawing Sheet

METHOD OF MAKING AN ELECTROPLATED INTERCONNECTION WIRE OF A COMPOSITE OF METAL AND CARBON NANOTUBES

FIELD OF THE INVENTION

The present invention relates to a method for forming an electroplated interconnection wire of a composite of metal and carbon nanotubes, particularly a method for forming an electroplated interconnection wire of a composite of copper metal and carbon nanotubes.

BACKGROUND OF THE INVENTION

U.S. Pat. No. 6,709,562 B1 discloses a method for producing a sub-micron interconnection structure on an integrated circuit chip, which comprises forming an insulation material on a substrate, forming trenches in said insulation by a photolithography technique; forming a conductive layer as an electroplating base on said insulation material; electroplating a seamless conductor in an electroplating bath containing copper ions and additives; and removing the electroplated conductor layer outside the trenches by polishing. The disclosure of said patent is incorporated herein by reference.

U.S. Pat. No. 5,916,642 discloses a method of encapsulating a material in a carbon nanotube comprising generating a vapor of the material to be encapsulated, generating a hydrogen arc discharge that discharges encapsulating material and the products discharged from the hydrogen arc discharge proximate a surface to encapsulate the material in a carbon nanotube. However, this method is not applicable on a substrate with a large surface area.

SUMMARY OF THE INVENTION

A primary objective of the present invention is to provide a method for forming an electroplated interconnection wire of a composite of carbon nanotubes and a metal (e.g. copper). Said electroplated interconnection wire, when used as a conductive channel, has an increased current density and a reduced electromigration resistance of copper. Furthermore, since carbon nanotubes have a high Young's modulus (1 Tpa ~1.24 TPa), the electroplated interconnection wire of a composite of carbon nanotubes and a metal formed according to the method of the present invention has improved mechanical strength in comparison with a copper wire. When an interconnection wire formed between devices on a flexible substrate, it must have a higher ductility and a higher strength. The electroplated interconnection wire of a composite of carbon nanotubes and a metal formed according to the method of the present invention is very suitable for use as an interconnection wire on the flexible substrate.

The present invention discloses a method for forming an electroplated interconnection wire of a composite of carbon nanotubes and metal, which comprises carrying out electroplating process on a substrate having a conductive baseline on a surface thereof in an electroplating bath comprising metal ions and carbon nanotubes, so that an electroplated interconnection wire of a composite of carbon nanotubes and said metal on said conductive baseline.

Preferably, the method of the present invention further comprises forming a metal baseline on said surface of said substrate as said conductive baseline by photolithography.

Preferably, said composite of carbon nanotubes and metal is a composite of carbon nanotubes and copper, wherein electroplating bath comprises an electroplating aqueous solution containing copper ions and electrolyte anions, an organic solvent, and carbon nanotubes dispersed in said organic solvent. More preferably, said electroplating bath receives an ultrasonic oscillation during the electroplating process.

The present invention also discloses another method for forming an electroplated interconnection wire of a composite of carbon nanotubes and metal, which comprises preparing a dispersion of carbon nanotubes containing an organic solvent and carbon nanotubes dispersed in said organic solvent; printing said dispersion of carbon nanotubes on a surface of a substrate; removing by evaporation said organic solvent from said surface to form a conductive baseline; and carrying out an electroplating process on said surface in an electroplating bath containing metal ions to form an electroplated interconnection wire of a composite of carbon nanotubes and metal on said conductive baseline.

Preferably, said composite of carbon nanotubes and metal is a composite of carbon nanotubes and copper, wherein said electroplating bath comprises an electroplating aqueous solution containing copper ions and electrolyte anions.

Preferably, said composite of carbon nanotubes and metal is a composite of carbon nanotubes and copper, wherein said electroplating bath comprises an electroplating aqueous solution containing copper ions and electrolyte anions, an organic solvent, and carbon nanotubes dispersed in said organic solvent. More preferably, said electroplating bath receives an ultrasonic oscillation during said electroplating process.

DETAILED DESCRIPTION OF THE INVENTION

Figure 1:
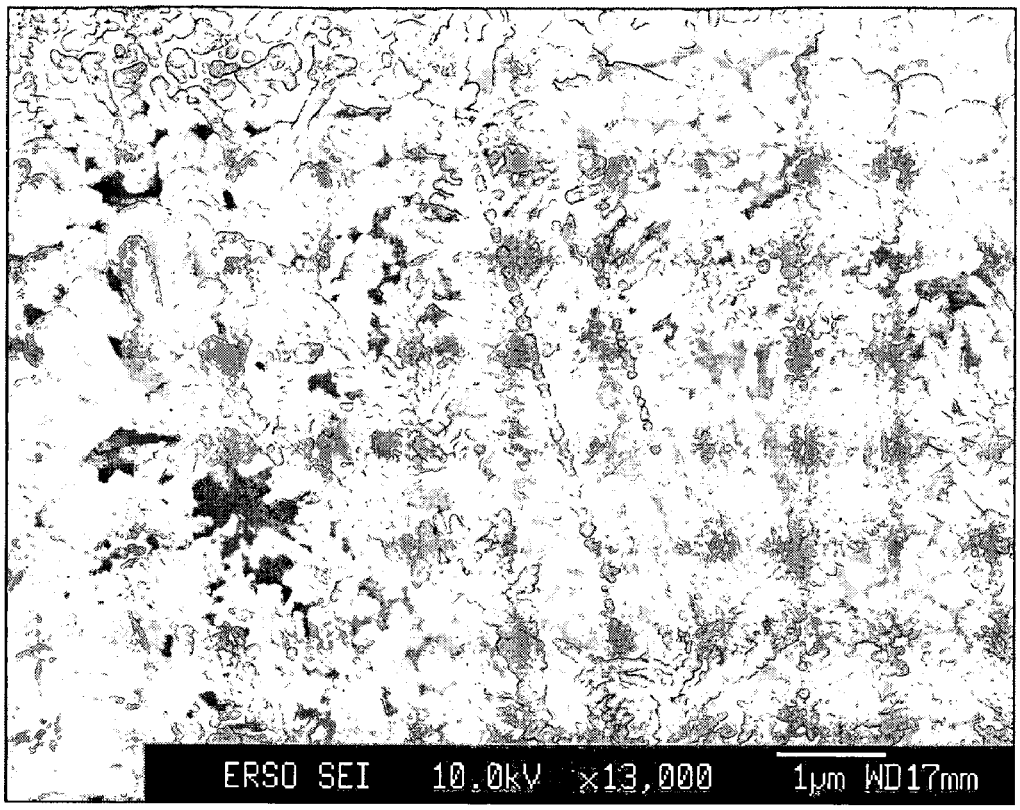
FIG. 1 and FIG. 2 show the SEM photos of a composite material of carbon nanotubes and copper formed on a reducing electrode by electroplating in an electroplating bath containing a mixture of a copper electroplating aqueous solution and a dispersion of carbon nanotubes, wherein the electroplating time is 80 seconds for FIG. 1 and 300 seconds for FIG. 2.

The present invention provides a method for forming an interconnection wire on a substrate having a large surface area, wherein said interconnection wire is a composite material of carbon nanotubes and a metal (e.g. copper). The invented method is applicable on forming an interconnection wire on a blank substrate, or forming an interconnection wire which connects devices provided on a substrate. A method according to the present invention comprises, firstly, forming a conductive baseline as an electroplating base on a surface of said substrate; and electroplating an interconnection wire of a composite material of carbon nanotubes and a metal on said conductive baseline. According to the material of said conductive baseline, the present invention can be implemented in two different manners. An embodiment using a flexible substrate will be described to illustrate the present invention.

On a flexible substrate formed of a polymer (e.g. polyimide), a metal (e.g. copper) baseline is formed as an electroplating base with a mask by sputtering or vaporization. Said substrate is immersed in an electroplating bath and connected to a negative electrode of a d.c. power source. Meanwhile, an anode (e.g. porous platinum) is immersed in said electroplating bath and connected to the positive electrode of said d.c. power source, thereby metal ions in the electroplating bath are reduced to elemental metal on the metal baseline. One of the features of the present invention includes that said electroplating bath is further blended with carbon nanotubes, e.g. a mixture of a conventional electroplating aqueous solution of copper and a dispersion of carbon nanotubes. Preferably, said dispersion of carbon nanotubes includes an organic solvent (e.g. dimethylformamide; DMF) and single-walled or multi-walled carbon nanotubes dispersed therein. During the electroplating, said electroplating bath is subjected to an ultrasonic oscillation in order to uniformly disperse carbon nanotubes in said electroplating bath. A composite material of carbon nanotubes and copper is thus formed on said copper baseline.

Another embodiment of the present invention in forming an electroplated interconnection wire of a composite material of carbon nanotubes and a metal comprises printing by, for example ink-jet printing, a pattern on a surface of a flexible substrate using the above-mentioned dispersion of carbon nanotubes; removing said organic solvent from the printed pattern by evaporation to form a conductive baseline; carrying out an electroplating process on said surface in an electroplating bath containing metal ions, for example, a conventional electroplating aqueous solution containing copper ions, to form an electroplated interconnection wire of a composite material of carbon nanotubes and a metal (e.g. copper) on said conductive baseline.

In order to determine an appropriate content of carbon nanotubes in the dispersion used in the method of the present invention, a specified weight of carbon nanotubes is dispersed in DMF first. Said dispersion is printed on an insulation substrate, and DMF contained therein is then removed by evaporation. The resulting printed wire containing carbon nanotubes is measured for an electric current by applying a constant voltage. If the measured current does not meet a desired value (e.g. μA current level), the content of carbon nanotubes for pressing said dispersion is increased until a desired value of current is measured, thereby obtaining an appropriate dispersion containing carbon nanotubes for use in the method of the present invention. Next, a colorimetric method is used for the purpose of replicating said dispersion containing carbon nanotubes.

Figure 2:
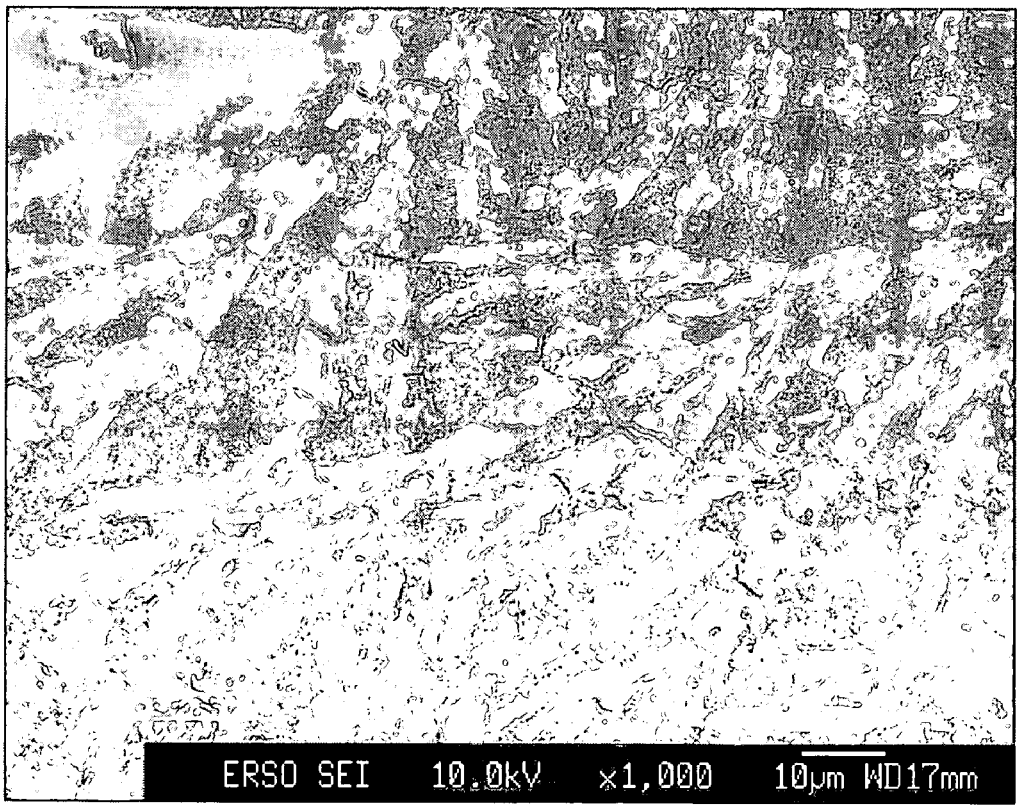

FIG. 1 and FIG. 2 show SEM photos of an electroplated composite material of carbon nanotubes and copper formed by the method of the present invention, wherein the electroplating bath used was a mixture of an electroplating aqueous solution of copper and a DMF dispersion of carbon nanotubes. The electroplating time was 80 seconds for the electroplated composite material shown in FIG. 1 and 300 seconds for FIG. 2. The electroplating used a current of 0.180 A (a current density of 0.189 $A/cm^2$). During the electroplating process, said electroplating bath was subjected to an ultrasonic oscillation, and the temperature of said electroplating bath was kept at 24° C. Said electroplating bath was prepared by mixing a dispersion of carbon nanotubes in DMF and an electroplating aqueous solution in a volume ratio of 1:50. Said dispersion of carbon nanotubes in DMF was prepared by dispersing 3.74~11.2 ml of single-walled carbon nanotubes (Rice University) in one liter of DMF. The composition of said electroplating aqueous solution is listed in Table 1.

FIG. 1 and FIG. 2 indicate that a composite material consisted of carbon nanotubes and copper is successfully electroplated on the surface of a cathode.

TABLE 1

| Electroplating Aqueous Solution Composition | Cutek conc. |
|---|---|
| S-2001* (ml/L) | 19 |
| A-2001** (ml/L) | 4.6 |
| Copper (g/L) | 16.9 |
| Sulfuric acid (g/L) | 135 |

*Ultrafill S-2001 suppressor, Shipley Company, Marlborough, MA 01752, US

**Ultrafill A-2001 accelerator, Shipley Company, Marlborough, MA 01752, US

Although the present invention has been described with reference to specific details of certain embodiments thereof, it is not intended that such details should be regarded as limitations upon the scope of the invention except as and to the extent that they are included in the accompanying claims. Many modifications and variations are possible in light of the above disclosure.

The invention claimed is:

1. A method for forming an electroplated interconnection wire of a composite of carbon nanotubes and metal, which comprises preparing a dispersion of carbon nanotubes containing an organic solvent and carbon nanotubes dispersed in said organic solvent; printing said dispersion of carbon nanotubes on a surface of a substrate; removing by evaporation said organic solvent from said surface to form a conductive baseline; and carrying out an electroplating process on said surface in an electroplating bath containing metal ions to form an electroplated interconnection wire of a composite of carbon nanotubes and metal on said conductive baseline.

2. The method as claimed in claim 1, wherein said composite of carbon nanotubes and metal is a composite of carbon nanotubes and copper, wherein said electroplating bath comprises an electroplating aqueous solution containing copper ions and electrolyte anions.

3. The method as claimed in claim 2, wherein the substrate is a flexible polymer.

4. The method as claimed in claim 3, wherein the polymer is a polyimide.

5. The method as claimed in claim 1, wherein said composite of carbon nanotubes and metal is a composite of carbon nanotubes and copper, wherein said electroplating bath comprises an electroplating aqueous solution containing copper ions and electrolyte anions, an organic solvent, and carbon nanotubes dispersed in said organic solvent.

6. The method as claimed in claim 5, wherein said electroplating bath receives an ultrasonic oscillation during said electroplating process.

7. The method as claimed in claim 6, wherein said substrate is a flexible polymer.

8. The method as claimed in claim 7, wherein the polymer is a polyimide.

9. The method as claimed in claim 5, wherein the substrate is a flexible polymer.

10. The method as claimed in claim 9, wherein the polymer is a polyimide.

11. The method as claimed in claim 1, wherein the substrate is a flexible polymer.

12. The method as claimed in claim 11, wherein the polymer is a polyimide.

* * * * *